US007334529B1

(12) United States Patent
Liao

(10) Patent No.: US 7,334,529 B1
(45) Date of Patent: Feb. 26, 2008

(54) METAL SUPPORT BASE

(75) Inventor: Lin Po Liao, Taichung (TW)

(73) Assignee: Lih Yann Industrial Co. Ltd., Taichung (TW)

( * ) Notice: Subject to any disclaimer, the term of this patent is extended or adjusted under 35 U.S.C. 154(b) by 0 days.

(21) Appl. No.: 11/529,337

(22) Filed: Sep. 29, 2006

(51) Int. Cl.
*B65D 19/00* (2006.01)

(52) U.S. Cl. ..... 108/57.26; 144/64; 144/901

(58) Field of Classification Search ..... 144/286.5; 248/346.02; 404/41; 52/263, 590.1, 590.2, 52/391, 392; 108/51.11, 52.1, 53.1, 53.3, 108/57.26, 64, 901, 185
See application file for complete search history.

(56) References Cited

U.S. PATENT DOCUMENTS 5,105,746 A * 4/1992 Reynolds ..... 108/56.1
5,809,905 A * 9/1998 John et al. ..... 108/56.1
5,887,529 A * 3/1999 John et al. ..... 108/56.1
6,769,367 B2 * 8/2004 Schutz ..... 108/51.11

* cited by examiner

*Primary Examiner*—Shelley M. Self
(74) *Attorney, Agent, or Firm*—Birch, Stewart, Kolasch, & Birch, LLP

(57) ABSTRACT

A support base is made of metal by die casting for supporting heavy articles above for example ground or floor, and includes a rectangular flat grid plate having four corners from which pillars extend. Intermediate pillars extend from middle positions of long edge faces of the rectangle and a center pillar extends from a center of the rectangle. The rectangular grid plate has opposite end edges on which tenons and mortises are formed respectively and opposite side edges on which tenons and mortises are formed respectively so that a plurality of support bases can be connected together by the tenon-and-mortise coupling between adjacent support bases to expand a covering area of the support bases.

8 Claims, 6 Drawing Sheets

METAL SUPPORT BASE

BACKGROUND OF THE INVENTION

1. Field of the Invention

The present invention relates generally to a support base that has a flat structure having a large surface area for being laid on for example floor to support and isolate an article thereon from humidity of the floor surface or ground, and in particular to such a support base made of metal for supporting heavy articles thereon.

2. The Related Art

Machinery and/or large quantity of articles are commonly positioned on for example floor or ground and often a support base, such as pallets, timbers, and thick paper boards, is positioned below the machinery or the articles to isolate the articles from contacting contaminants or humidity on the floor or ground. For heavy articles, the support base is often collapsed, and even broken, or ages, for a long term use. This adversely affects safety and security of the articles and those of the surrounding in which the articles are stocked. Further, moving and organizing the conventional support base is very time-consuming and labor-consuming and is often subject to the space limitation of the surrounding where the articles are to be stocked.

Thus, it is desired to have a heavy-duty support base that can carry heavy articles for a long time without undesired damage or breaking.

SUMMARY OF THE INVENTION

Thus, the present invention is aimed to provide a support base that is made of metal castings so as to be of heavy duty for carrying heavy articles without damage or breaking.

The present invention also provides a metal support base that allows expansion in longitudinal and lateral directions in an easy and organized manner so as to facilitate laying of a large quantity of support bases to cover an expanded area.

To realize the above objectives, in accordance with the present invention, there is provided a support base made of metal by die casting for supporting heavy articles above for example ground or floor, and comprising a rectangular flat grid plate having four corners from which pillar extend. Intermediate pillars extend from middle positions of long edge faces of the rectangle and a center pillar extends from a center of the rectangle. The rectangular grid plate has opposite end edges on which tenons and mortises are formed respectively and opposite side edges on which tenons and mortises are formed respectively so that a plurality of support bases can be connected together by the tenon-and-mortise coupling between adjacent support bases to expand a covering area of the support bases.

BRIEF DESCRIPTION OF THE DRAWINGS

The present invention will be apparent to those skilled in the art by reading the following description of a preferred embodiment thereof, with reference to the attached drawings, in which:

FIG. 3A is an enlarged view of a circled portion of FIG. 3;

DETAILED DESCRIPTION OF THE PREFERRED EMBODIMENT

Figures 1, 1A:
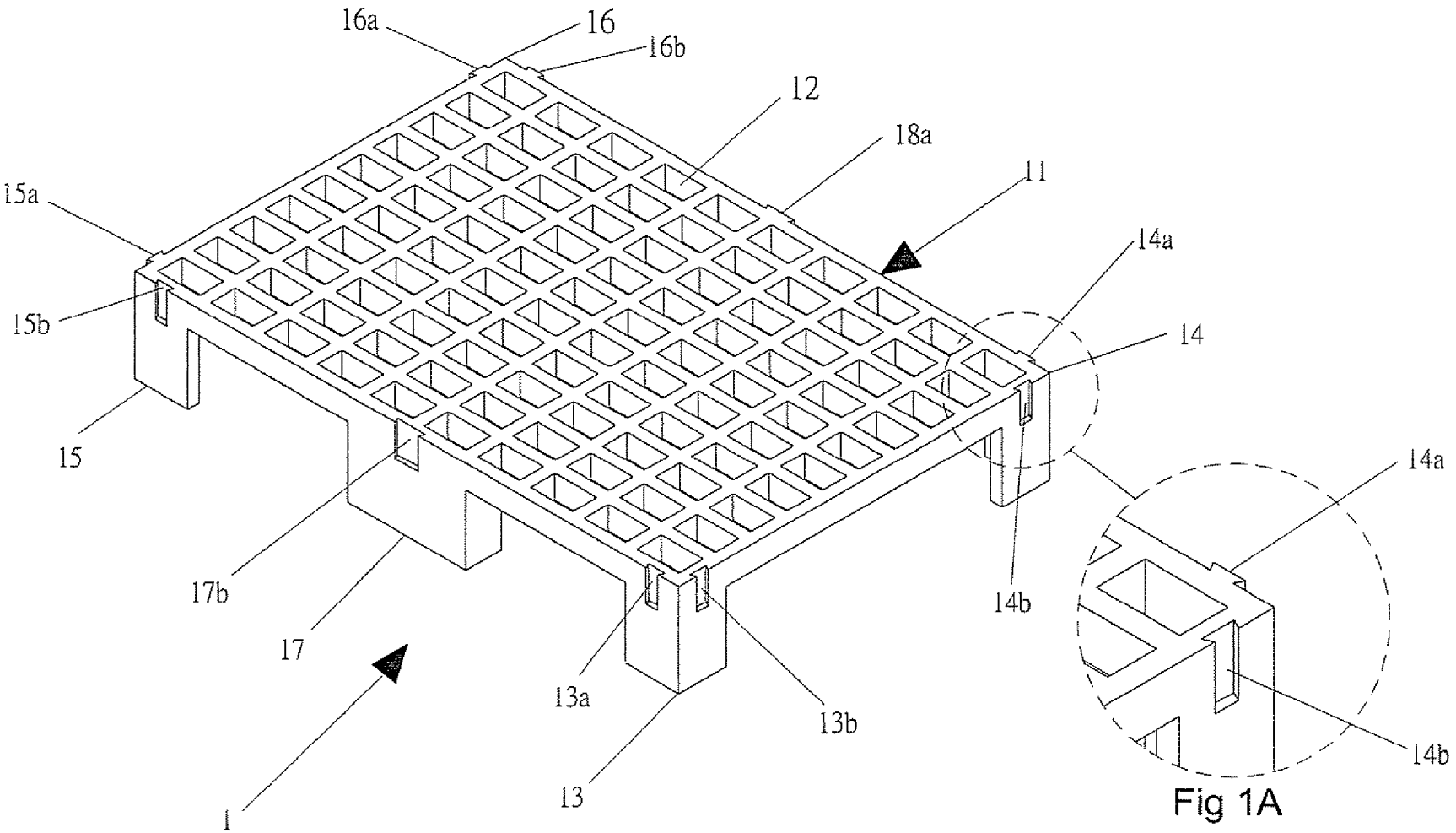
FIG. 1 is a perspective view showing a support base constructed in accordance with the present invention.
FIG. 1A is an enlarged view of a circled portion of FIG. 1.
Figure 2:
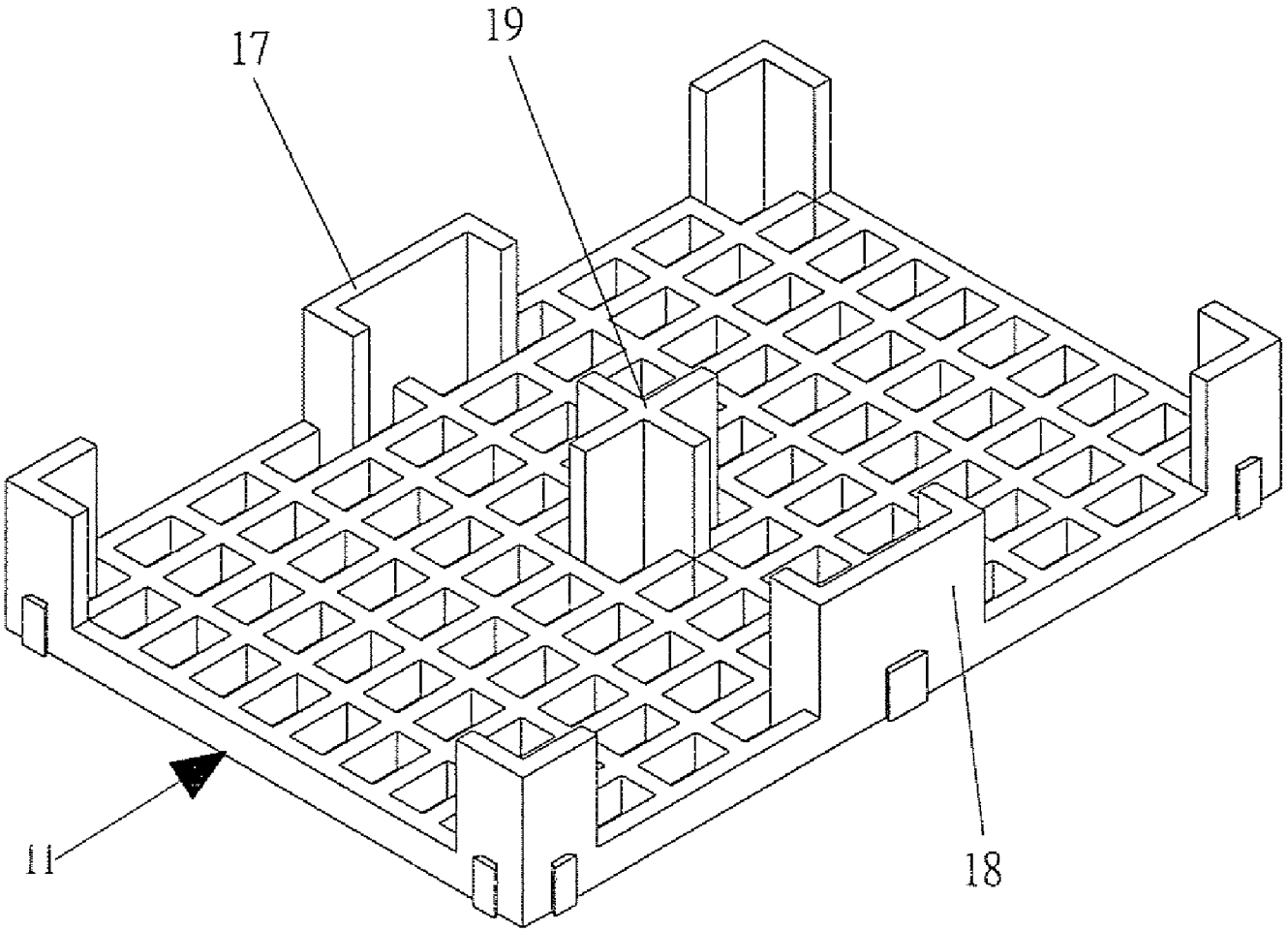
FIG. 2 is also a perspective view of the support base of the present invention taken from a bottom side.

With reference to the drawings and in particular to FIGS. 1, 1A, and 2, a support base constructed in accordance with the present invention, generally designated with reference numeral 1, is made of a rigid and strong material by known means, such as die castings of metal. The support base 1 has a flat body 11 in the form of a rectangular grid plate comprising a plurality of longitudinally extending ribs and laterally extending ribs intersecting each other and defining hollow cells 12. Thus, the body 11 has two opposite end edges that extend in the lateral directions and are spaced from each other in the longitudinal direction and two opposite side edges that extend in the longitudinal direction and are spaced from each other in the lateral direction whereby the end edges and the side edges intersect each other at four corners, which are right-angled in the embodiment illustrated, but do not need to be so.

Pillars 13, 14, 15, 16 extend downward from the four corners respectively to define a height and are positionable on a fixture surface, such as a floor or ground. An intermediate pillar 17, 18 is formed at a middle position along each side edge so that the intermediate pillar 17, 18 is substantially midway between two opposite pillars 13, 15 (or 14, 16). A further center pillar 19 is formed at a center of the rectangular plate of the body 11. The intermediate pillars 17, 18 and the center pillar 19 extend downward from the flat plate to be positioned on for example the ground.

On the face of one of the end edges, a plurality of recesses or mortise slots are defined, and on the face of the other one of the end edges, corresponding projections or tenons are formed, whereby when two support bases 1 of the present invention are positioned next to each other in an end-by-end manner, the projections or tenons of a first one of the two support base 1 are fit into and engageable with the recesses or the mortise slots defined in a second one of the two support bases 1 so that the two support bases 1 are connected together to expand to a larger coverage area in the longitudinal direction.

In the embodiment illustrated, a mortise slot 13*b*, 14*b* is defined in a first end face of the rectangular grid plate 11 at a location corresponding to each pillar 13, 13 of that first end edge, and a tenon projection 15*a*, 16*a* is formed in a second end face of the rectangular grid plate 11 at a location corresponding to each pillar 15, 16 of that second end edge. The mortise slots 13*b*, 14*b* extend in a direction substantially parallel to the height of the pillars 13, 14, 15, 16. The length of the mortise slots 13*b*, 14*b* measured along the height direction is substantially the same as the length of the tenon projections 15*a*, 16*a* measured in the height direction, or the length of the mortise slots 13*b*, 14*b* is longer than that of the tenon projections 15*a*, 16*a* to ensure proper receipt of the projections 15*a*, 16*a* in the mortise slots 13*b*, 14*b* when two support bases 1 are connected end by end.

Similarly, on the face of one of the side edges, a plurality of recesses or mortise slots are defined, and on the face of the other one of the side edges, corresponding projections or tenons are formed, whereby when two support bases 1 of the present invention are positioned next to each other in an side-by-side manner, the projections or tenons of a first one of the two support base 1 are fit into and engageable with the recesses or the mortise slots defined in a second one of the two support bases 1 so that the two support bases 1 are connected together to expand to a larger coverage area in the lateral direction.

In the embodiment illustrated, a mortise slot 13*a*, 15*b*, 17*b* is defined in a first side face of the rectangular grid plate 11 at a location corresponding to each pillar 13, 15 of that first side edge and the intermediate pillar 17, and a tenon projection 14*a*, 16*b*, 18*a* is formed in a second side face of the rectangular grid plate 11 at a location corresponding to each pillar 15, 16 of that second side edge, and the intermediate pillar 18. The mortise slots 13*a*, 15*b*, 17*b* extend in a direction substantially parallel to the height of the pillars 13, 14, 15, 16. The length of the mortise slots 13*a*, 15*b*, 17*b* measured along the height direction is substantially the same as the length of the tenon projections 14*a*, 16*b*, 18*a* measured in the height direction, or the length of the mortise slots 13*a*, 15*b*, 17*b* is longer than that of the tenon projections 14*a*, 16*b*, 18*b* to ensure proper receipt of the projections 14*a*, 16*b*, 18*b* in the mortise slots 13*a*, 15*b*, 17*b* when two support bases 1 are connected side by side.

In the embodiment illustrated, and as best seen in FIG. 1A, the mortise slots and the tenon projections are dovetail-shaped. However, it is apparent that other shapes of the mortise and tenon can be used, provided they can ensure inter-engagement with each other to connect two support bases 1 together. Also, as shown in the drawings, the length of the mortise slots is substantially shorter than the height of the pillars so that engagement between two support bases 1 can be done efficiently and easily In other words, the mortise slots and the tenon projections do not extend along the full height of the pillars.

Figure 3:
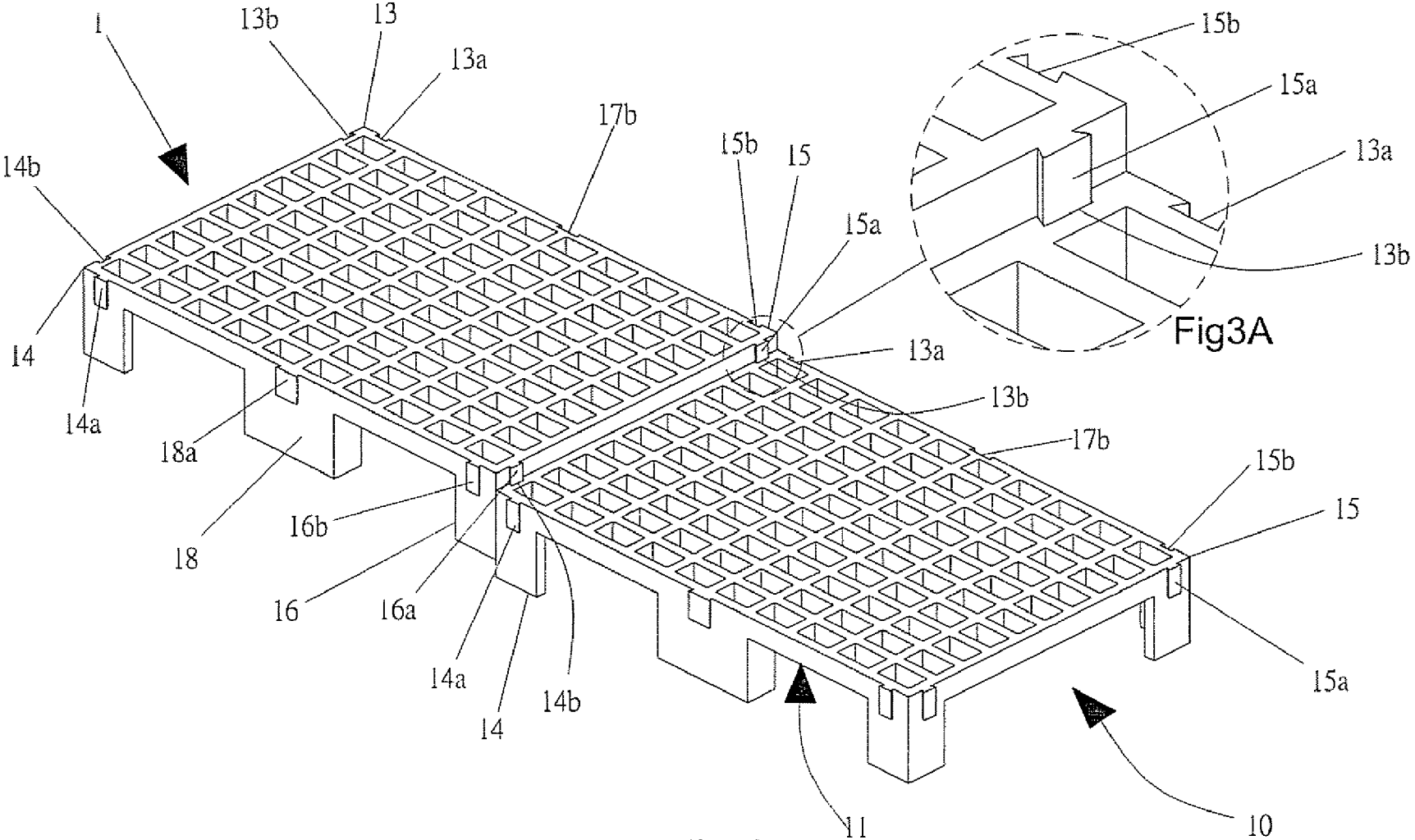
FIG. 3 is a perspective view showing a process of connecting two support bases of the present invention in an end by end manner.
Figure 4:
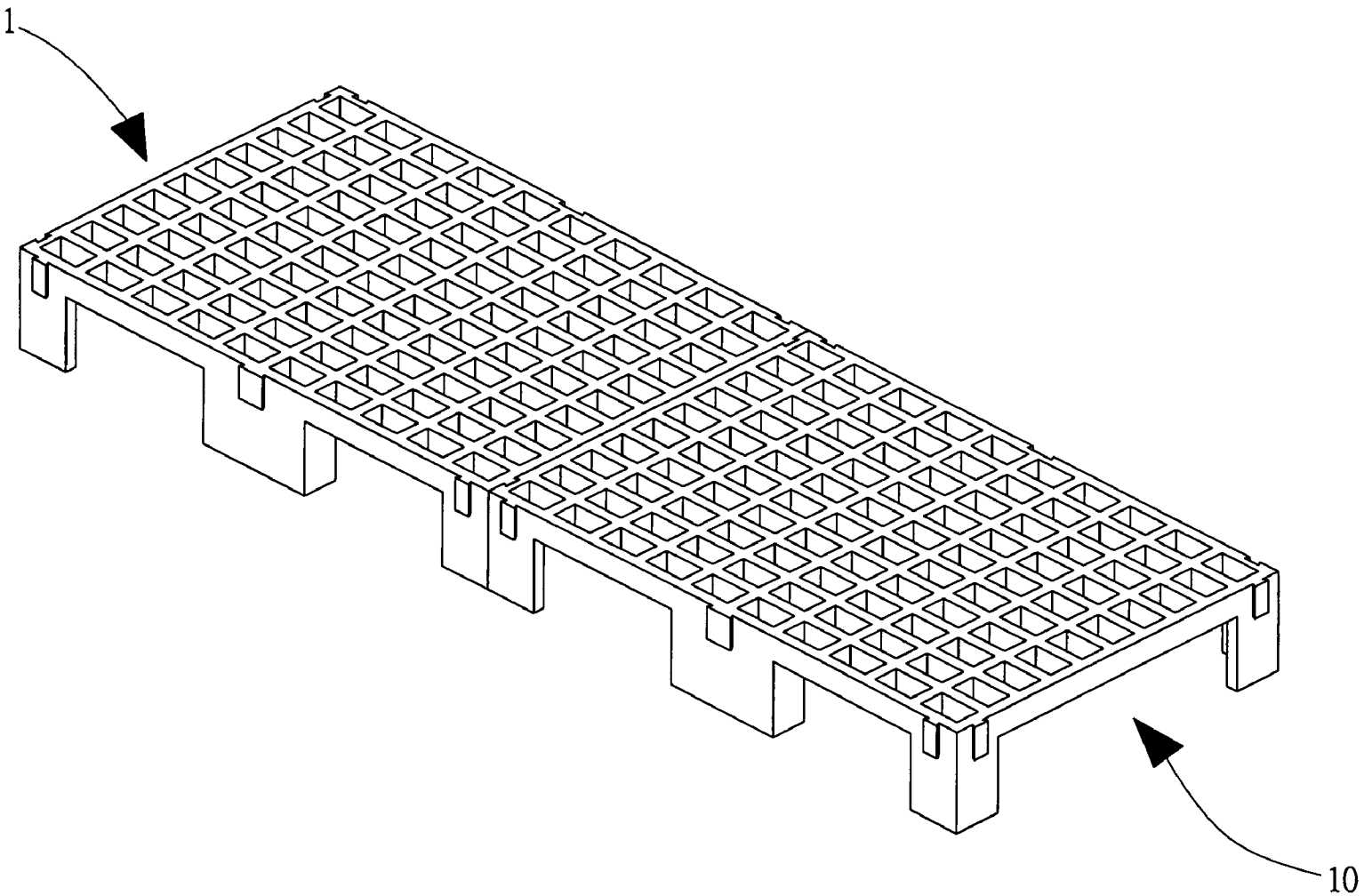
FIG. 4 is a perspective view showing two support bases of the present invention are connected together in the end by end manner.

Also referring to FIGS. 3 and 3A, to connect two support bases 1 in an end-by-end manner, the tenon projections 15*a*, 16*a* of a first support base 1 are simultaneously fit into the mortise slots 13*b*, 14*b* of a second support base 1 to have the tenon projections 15*a*, 16*a* and the mortise slots 13*b*, 14*b* engaging each other and thus connecting the two support bases 1 together in an end-by-end manner. Once the tenon projections 15*a*, 16*a* are completely received in the mortise slots 13*b*, 14*b*, the grid plates 11 of the two support bases 1 align with each other and top surfaces of the grid plates 11 flush with each other, as shown in FIG. 4. Thus, the support bases 1 are expanded in the longitudinal direction.

Figure 5:
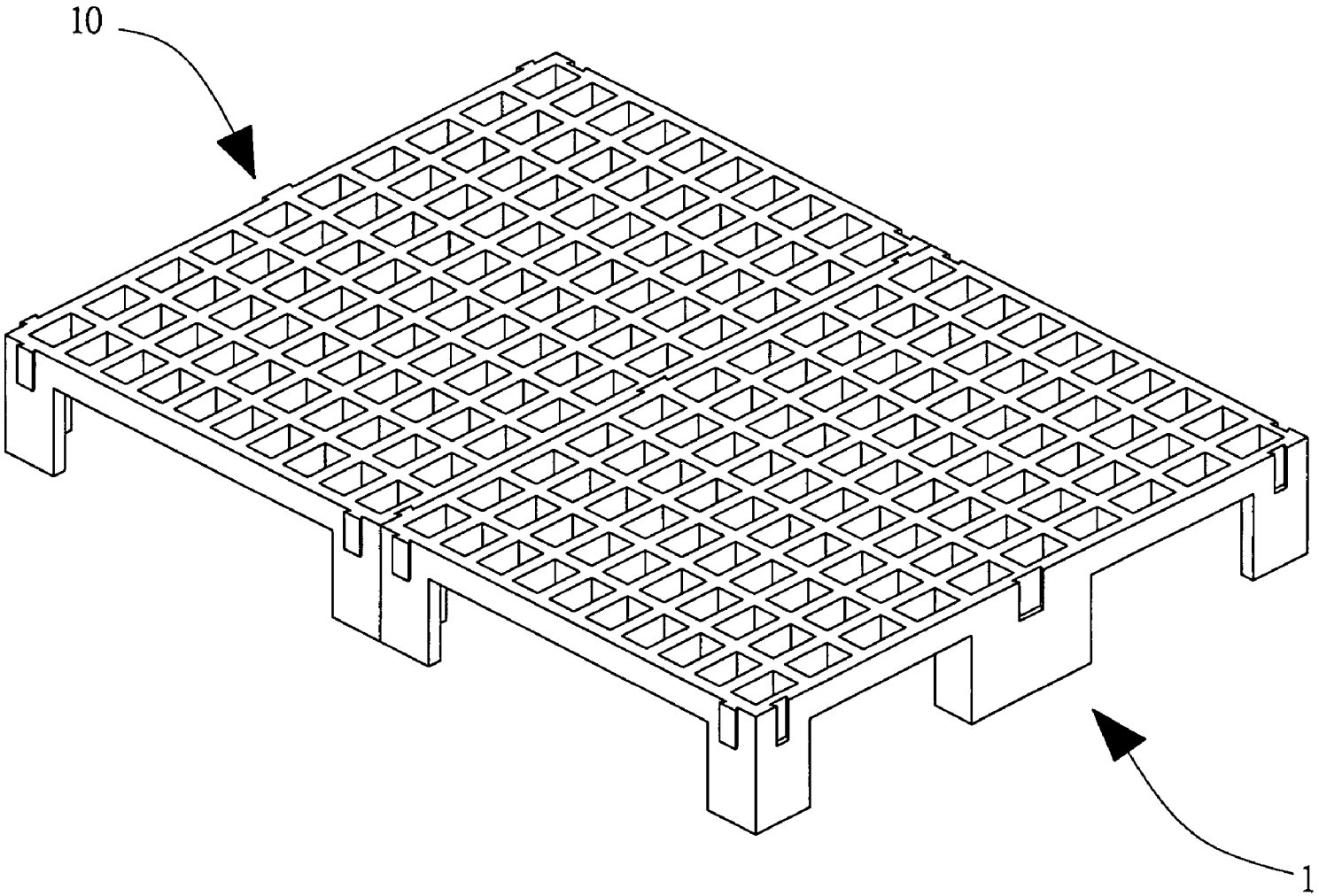
FIG. 5 is perspective view showing two support bases of the present invention are connected together in a side by side manner.

Referring to FIG. 5, similarly, to expand the support bases 1 in the lateral direction, the tenon projections 14*a*, 16*b*, 18*a* of the first side face of a first support base 1 are simultaneously fit into the mortise slots 13*a*, 15*b*, 17*b* of the second side face of a second support base 1 to connect two support bases 1 together. In this way, the two support bases 1 are connected together side by side and the support bases 1 can expand in the lateral direction.

Figure 6:
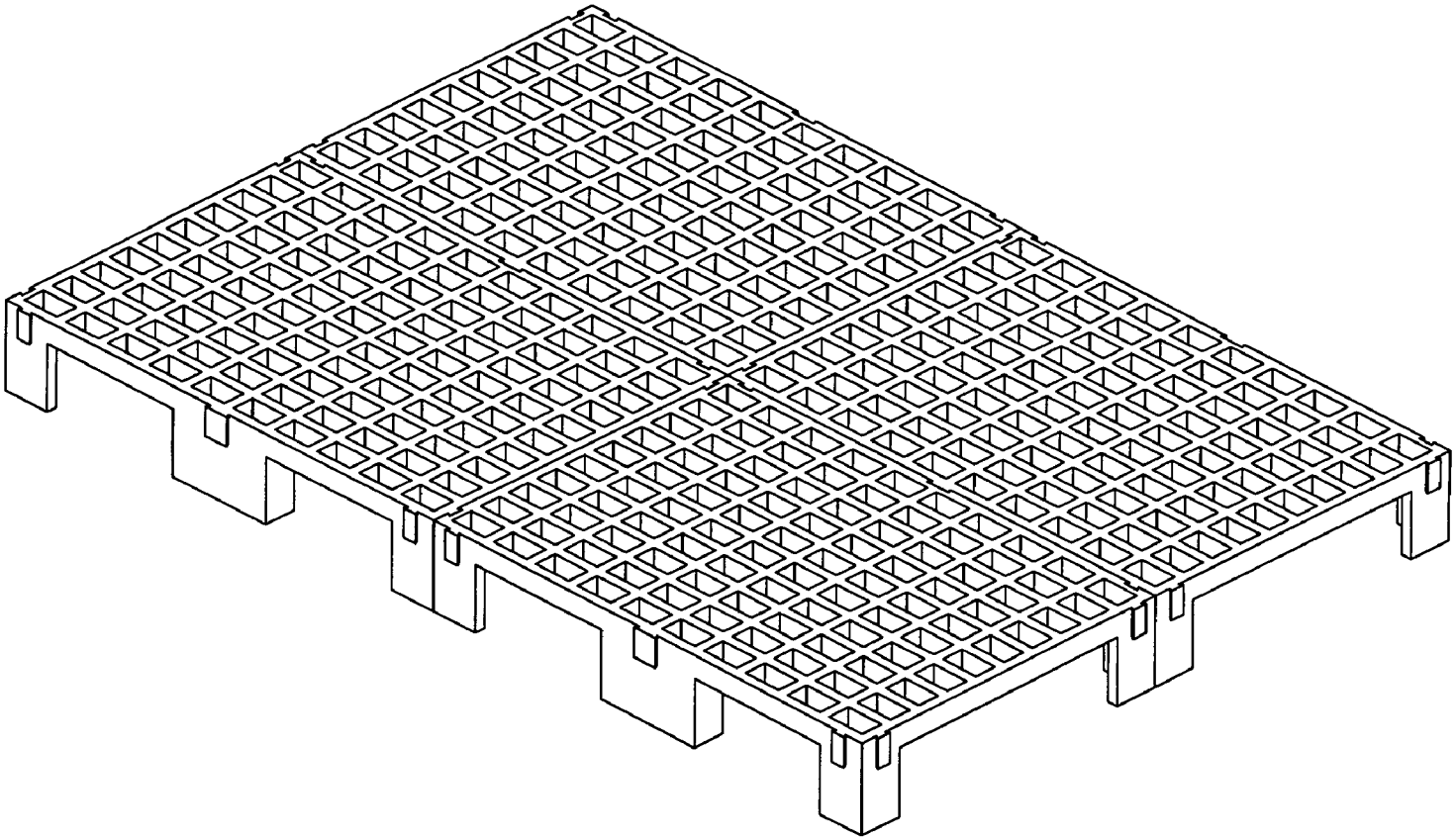
FIG. 6 is a perspective view showing four support bases of the present invention connected together.

Apparently, the support base 1 can expand in both the longitudinal direction and the lateral direction by connecting four support bases 1 together as shown in FIG. 6. The connection between adjacent support bases 1 in either the longitudinal direction or the lateral direction is the same as those described with reference to FIGS. 3 and 4. Thus, detailed description is no longer needed for the expansion of the support base 1 shown in FIG. 6.

It is apparent from the above description that the mortise-and-tenon connection between adjacent ones of the support base 1 of the present invention allows the support bases 1 to be securely and firmly connected in an efficient and effective manner.

Further, the support base of the present invention is made of a rigid material, such as metal, so that the support base is of a heavy-duty structure that supports heavy articles thereon and isolates the articles from contact with contaminant or humidity on the floor or ground by the downward-extending pillars.

Further, the support base can easily expand by connecting a plurality of the support bases in both the longitudinal and lateral directions without requiring any special tools so that the expansion of the support base can be made easily in any limited space and at any locations.

Although the present invention has been described with reference to the preferred embodiment with reference to the drawings thereof, it is apparent to those skilled in the art that a variety of modifications and changes may be made without departing from the scope of the present invention which is intended to be defined by the appended claims.

What is claimed is:

1. A support base comprising a flat body made of a rigid material in the form of a grid plate having a plurality of hollow cells, and having edges intersecting each other to define corners from each of which a pillar extends downwardly and positioned on a fixture to separate the grid plate from the fixture surface, one edge of the flat body having a surface in which mortise slots are respectively defined at locations corresponding to the pillars associated with said one edge, and an opposite edge of the flat body having a surface on which tenon projections respectively engageable with the mortise slots are respectively formed at locations corresponding to the pillars associated with said opposite edge, whereby when two support bases are placed next to each other with the tennon projections engaging the mortise slots, the support bases are connected together in a detachable manner.

2. The support base as claimed in claim 1, wherein the support base is made of metal by die casting.

3. The support base as claimed in claim 1, wherein the flat body is rectangular, having first and second opposite end faces extending in a lateral direction and spaced from each other in a longitudinal direction and first and second opposite side faces extending in the longitudinal direction and spaced from each other in the lateral direction, the end faces and the side faces intersecting each other to define four corners from which the pillars extend.

4. The support base as claimed in claim 3, wherein the flat body further comprises an intermediate pillar extending from a middle position of each side face and a center pillar extending from a center of the flat body.

5. The support base as claimed in claim 1, wherein the flat body is rectangular, having first and second opposite end faces extending in a lateral direction and spaced from each other in a longitudinal direction and first and second opposite side faces extending in the longitudinal direction and spaced from each other in the lateral direction, the first end face forming a plurality of mortise slots and the second end face forming a plurality of tenon projections corresponding to and engageable with the mortise slots of the first end face, the first side face forming a plurality of mortise slots and the second side face forming a plurality of tenon projections corresponding to and engageable with the mortise slots of the first side face.

6. The support base as claimed in claim 4, wherein the first end face forms a mortise slot at a location corresponding to each pillar and the second end face forms a tenon projection corresponding to and engageable with the mortise slot at a location corresponding to each pillar, and wherein the first side face forms a mortise slot at a location corresponding to each pillar and each intermediate pillar and the second side face forms a tenon projection corresponding to and engageable with the mortise slot at a location corresponding to each pillar and each intermediate pillar.

7. The support base as claimed in claim 6, wherein the tenon projections and the mortise slots are dovetail-shaped.

8. The support base as claimed in claim 1, wherein the tenon projections comprise dovetail tenons and the mortise slots comprise dovetail mortises.

* * * * *